US005594305A

United States Patent [19]

Primm et al.

[11] Patent Number: 5,594,305

[45] Date of Patent: Jan. 14, 1997

[54] POWER SUPPLY FOR USE WITH SWITCHED ANODE FIELD EMISSION DISPLAY INCLUDING ENERGY RECOVERY APPARATUS

[75] Inventors: Charles E. Primm, Plano, Tex.; Gary Fourer, San Luis Obispo, Calif.

[73] Assignee: Texas Instruments Incorporated, Dallas, Tex.

[21] Appl. No.: 472,167

[22] Filed: Jun. 7, 1995

[51] Int. Cl.[6] ..... G09G 3/10

[52] U.S. Cl. ..... 315/169.3; 315/227 R; 315/240; 315/239

[58] Field of Search ..... 315/169.1, 169.3, 315/227 R, 228, 240, 209 R, 239; 363/15, 71, 129, 131

[56] References Cited

U.S. PATENT DOCUMENTS

| | | | |
|---|---|---|---|
| 3,755,704 | 8/1973 | Spindt et al. | 313/309 |
| 4,940,916 | 7/1990 | Borel et al. | 313/306 |
| 5,194,780 | 3/1993 | Meyer | 315/169.3 |
| 5,225,820 | 7/1993 | Clerc | 340/752 |
| 5,227,696 | 7/1993 | Asars | 315/169.3 |
| 5,235,253 | 8/1993 | Sato | 315/169.3 |
| 5,262,931 | 11/1993 | Vingsbo | 363/16 |
| 5,274,539 | 12/1993 | Steigerwald et al. | 363/20 |
| 5,302,966 | 4/1994 | Stewart | 315/169.3 X |

*Primary Examiner*—Robert Pascal
*Assistant Examiner*—Haissa Philogene
*Attorney, Agent, or Firm*—Christopher L. Maginniss; James C. Kesterson; Richard L. Donaldson

[57] ABSTRACT

A switching power supply 38 for use in a switched anode, field emission flat panel display includes energy recovery modules $\mathbf{48}_R$, $\mathbf{48}_G$ and $\mathbf{48}_B$ for recovering energy from each anode electrode $\mathbf{50}_R$, $\mathbf{50}_G$ and $\mathbf{50}_B$ of the display as the voltage on the anode $V_A$ is switched from a high level to a low level, and for restoring this energy to the anode as the voltage is returned from the low level back to the high level. Each energy recovery module 48 includes a capacitor 62 for storing charge and an inductor 60 for storing energy. During the deactivation period of each anode electrode 50, dc source 40 is uncoupled from anode electrode 50 and energy is transferred from the anode electrode 50 to inductor 60, and subsequently from inductor 60 to storage capacitor 62. During the re-activation period, energy transfers from storage capacitor 62 to inductor 60 and anode electrode 50, and subsequently from inductor 60 to anode electrode 50. All of the recovered energy (minus the circuit losses) is returned to anode electrode 50. At this time, dc source 40 is recoupled to anode electrode 50, providing current thereto. The transfer and storage of energy, and its reuse when the anode electrode 50 is switched back to its high voltage state, allows the recovery of as much as eighty percent of the energy applied to the anode electrodes.

11 Claims, 5 Drawing Sheets

POWER SUPPLY FOR USE WITH SWITCHED ANODE FIELD EMISSION DISPLAY INCLUDING ENERGY RECOVERY APPARATUS

TECHNICAL FIELD OF THE INVENTION

The present invention relates generally to power supplies used in field emission display systems and, more particularly, to a switching power supply for use with a switched anode field emission display.

BACKGROUND OF THE INVENTION

The advent of portable computers has created intense demand for display devices which are lightweight, compact and power efficient. Since the space available for the display function of these devices precludes the use of a conventional cathode ray tube (CRT), there has been significant interest in efforts to provide satisfactory flat panel displays having comparable or even superior display characteristics, e.g., brightness, resolution, versatility in display, power consumption, etc. These efforts, while producing flat panel displays that are useful for some applications, have not produced a display that can compare to a conventional CRT.

Currently, liquid crystal displays are used almost universally for laptop and notebook computers. In comparison to a CRT, these displays provide poor contrast, only a limited range of viewing angles is possible, and, in color versions, they consume power at rates which are incompatible with extended battery operation. In addition, color liquid crystal display screens tend to be far more costly than CRT's of equal screen size.

As a result of the drawbacks of liquid crystal display technology, field emission display technology has been receiving increasing attention by industry. Flat panel displays utilizing such technology employ a matrix-addressable array of pointed, thinfilm, cold field emission cathodes in combination with an anode comprising a phosphor-luminescent screen. The phenomenon of field emission was discovered in the 1950's, and extensive research by many individuals, such as Charles A. Spindt of SRI International, has improved the technology to the extent that its prospects for use in the manufacture of inexpensive, low-power, high-resolution, high-contrast, fullcolor flat displays appear to be promising.

Advances in field emission display technology are disclosed in U.S. Pat. No. 3,755,704, "Field Emission Cathode Structures and Devices Utilizing Such Structures," issued 28 Aug. 1973, to C.A. Spindt et al.; U.S. Pat. No. 4,940,916, "Electron Source with Micropoint Emissive Cathodes and Display Means by Cathodoluminescence Excited by Field Emission Using Said Source," issued 10 Jul. 1990 to Michel Borel et al.; U.S. Pat. No. 5,194,780, "Electron Source with Microtip Emissive Cathodes," issued 16 Mar. 1993 to Robert Meyer; and U.S. Pat. No. 5,225,820, "Microtip Trichromatic Fluorescent Screen," issued 6 Jul. 1993, to Jean-Frederic Clerc. These patents are incorporated by reference into the present application.

The Clerc ('820) patent discloses a trichromatic field emission flat panel display having a first substrate on which are arranged a matrix of conductors. In one direction of the matrix, conductive columns comprising the cathode electrode support the microtips. In the other direction, above the column conductors, are perforated conductive rows comprising the gate electrode. The row and column conductors are separated by an insulating layer having apertures permitting the passage of the microtips, each intersection of a row and column corresponding to a pixel.

On a second substrate facing the first, the display has regularly spaced, parallel conductive stripes comprising the anode electrode. These stripes are alternately covered by a first material luminescing in the red, a second material luminescing in the green, and a third material luminescing in the blue, the conductive stripes covered by the same luminescent material being electrically interconnected.

The Clerc patent discloses a process for addressing a trichromatic field emission flat panel display. The process consists of successively raising each set of interconnected anode stripes periodically to a first potential which is sufficient to attract the electrons emitted by the microtips of the cathode conductors corresponding to the pixels which are to be illuminated or "switched on" in the color of the selected anode stripes. Those anode stripes which are not being selected are set to a potential such that the electrons emitted by the microtips are repelled or have an energy level below the threshold cathodoluminescence energy level of the luminescent materials covering those unselected anodes.

An example given in the Clerc patent recites voltages on the anode electrodes for attracting emitted electrons in the range of 100–150 volts, with the voltage on the unselected anode electrodes at 40 volts. Recent experimentation, however, has indicated that substantially higher attracting voltages, in the range of 500–800 volts, are required to provide a satisfactory display, while the voltage on the unselected anode electrodes must be substantially zero for the desired purity of color. Since the attracting voltage on each anode electrode is switched on for a color field (or subframe) period of 5.56 milliseconds in each frame period of 16.67 milliseconds, for an illustrative frame rate of sixty frames per second, the switching losses for a several-hundred-volt swing at that rate are substantial. Where the field emission display device is used in a portable, battery-operated system, such as a notebook computer, large switching losses are incompatible with a desired goal of extended battery life.

In view of the above, it is clear that there exists a need for an apparatus for reducing the switching losses in a switched anode, field emission display, while permitting the use of anode voltages in the range of 500–800 volts, and switching the voltage on the unselected anode electrodes to substantially zero.

SUMMARY OF THE INVENTION

In accordance with the principles of the present invention, there is disclosed herein an apparatus which provides a potential intermittently across a substantially capacitative load device. The apparatus comprises terminal means coupled to a source of the potential, voltage storage means and first switching means for selectively coupling the terminal means to the load device and to the voltage storage means. The apparatus also comprises energy storage means coupled at a first terminal thereof to the load device and second switching means for selectively coupling a second terminal of the energy storage means to the voltage storage means. The apparatus further comprises third switching means for selectively coupling the second terminal of the energy storage means to a reference potential. In a preferred embodiment of the present invention, the first, second and third switching means comprise transistors, the voltage storage means comprises a capacitor, and the energy storage means comprises an inductor.

Further in accordance with the present invention, there is disclosed a switching power supply which provides dc potentials sequentially across a plurality of substantially capacitative load devices, the dc potentials being individually determined for each of the load devices. The power supply comprises means responsive to an energy source and responsive to a plurality of control voltages for providing at an output terminal thereof sequences of the dc potentials. The power supply also comprises energy recovery modules equal in number to the number of load devices, each of the energy recovery modules coupled to an individual one of the load devices and to the providing means output terminal. Each of the energy recovery modules comprises voltage storage means, first switching means for selectively coupling the dc potential from the output terminal of the providing means to the one load device and to the voltage storage means, and energy storage means coupled at a first terminal thereof to the one load device. Each energy recovery module also comprises second switching means for selectively coupling a second terminal of the energy storage means to the voltage storage means, and third switching means for selectively coupling the second terminal of the energy storage means to a reference potential. The switching power supply further comprises means coupled to the plurality of energy recovery modules for generating timing control signals to the first, second and third switching means thereof.

Still further in accordance with the present invention, there is disclosed a method of conserving energy in an apparatus which supplies switched power to a load device, the power alternating between a first potential and a second potential. The method comprises the steps of: (a) coupling a source of the first potential to the load device and to a voltage storage device; (b) transferring energy from the load device to the voltage storage device; (c) transferring energy from the voltage storage device to the load device; and (d) repeating steps (a) through (c).

BRIEF DESCRIPTION OF THE DRAWING

The foregoing features of the present invention may be more fully understood from the following detailed description, read in conjunction with the accompanying drawings, wherein.

DESCRIPTION OF THE PREFERRED EMBODIMENT

Figure 1:
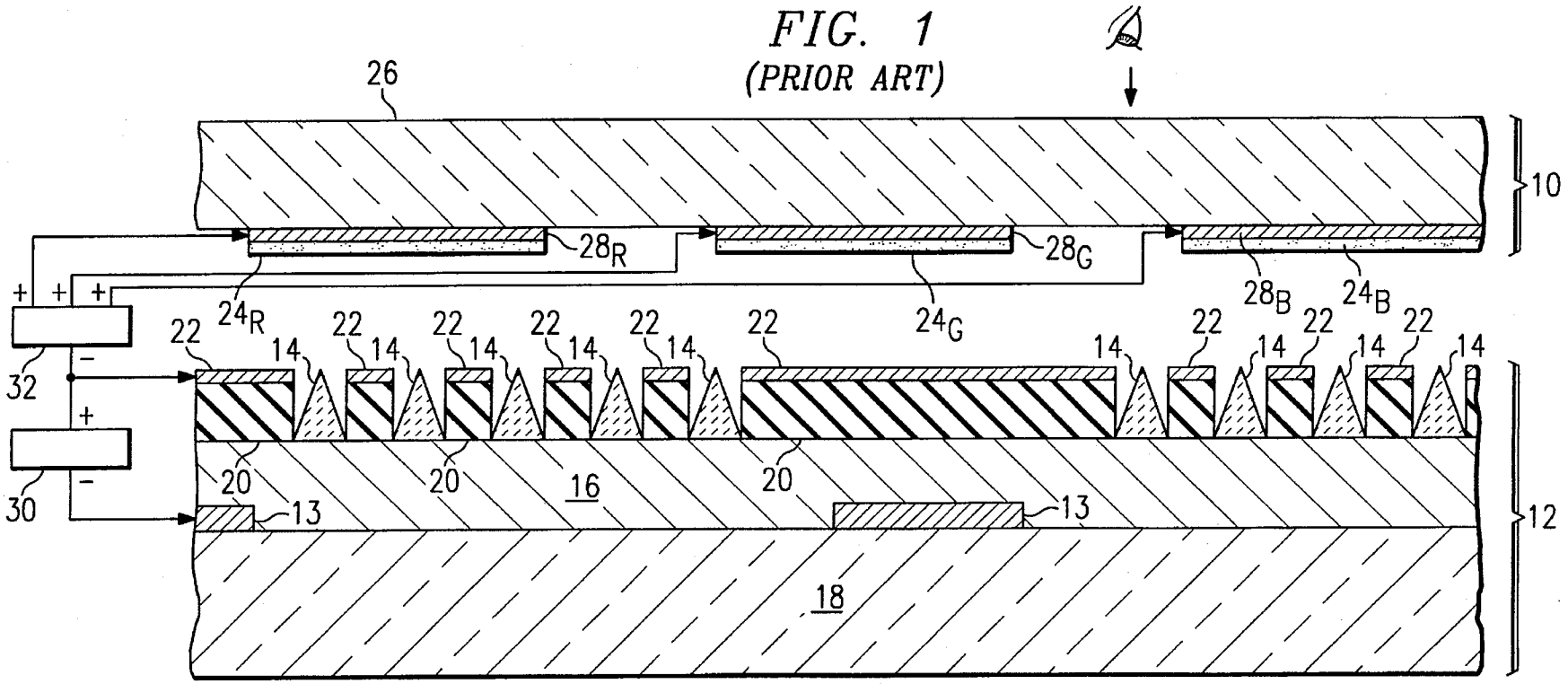
FIG. 1 (PRIOR ART)
FIG. 1 illustrates in cross section a portion of a trichromatic field emission flat panel display device according to the prior art.

Referring initially to FIG. 1, there is shown, in cross-sectional view, a portion of an illustrative field emission flat panel display device, incorporating the principles taught in the Meyer ('780) and Clerc ('820) patents. In this embodiment, the field emission device comprises an anode plate having an electroluminescent phosphor coating facing an emitter plate, the phosphor coating being observed from the side opposite to its excitation.

More specifically, the illustrative field emission device of FIG. 1 comprises a cathodoluminescent anode plate 10 and an electron emitter (or cathode) plate 12. (No true scaling information is intended to be conveyed by the relative sizes and positioning of the elements of anode plate 10 and the elements of emitter plate 12 as depicted in FIG. 1 .) The cathode portion of emitter plate 12 includes conductors 13 formed on an insulating substrate 18, a resistive layer 16 also formed on substrate 18 and overlaying conductors 13, and a multiplicity of electrically conductive microtips 14 formed on resistive layer 16. In this example, conductors 13 comprise a mesh structure, and microtip emitters 14 are configured as an array within the mesh spacings.

A gate electrode comprises a layer of an electrically conductive material 22 which is deposited on an insulating layer 20 which overlays resistive layer 16. Microtip emitters 14 are in the shape of cones which are formed within apertures through conductive layer 22 and insulating layer 20. The thicknesses of gate electrode layer 22 and insulating layer 20 are chosen in conjunction with the size of the apertures therethrough so that the apex of each microtip 14 is substantially level with the electrically conductive gate electrode layer 22. Conductive layer 22 is arranged as rows of conductive bands across the surface of substrate 18, and the mesh structure of conductors 13 is arranged as columns of conductive bands across the surface of substrate 18, thereby permitting selection of microtips 14 at the intersection of a row and column corresponding to a pixel.

Anode plate 10 comprises regions of a transparent, electrically conductive material $\mathbf{28}_R$ (red), $\mathbf{28}_G$ (green) and $\mathbf{28}_B$ (blue), referred to collectively as conductors 28, deposited on a transparent planar support 26, which is positioned facing gate electrode 22 and parallel thereto, the conductors 28 being deposited on the surface of support 26 directly facing gate electrode 22. In this example, the regions of conductors 28, which comprise the anode electrode, are in the form of electrically isolated stripes comprising three series of parallel conductive bands across the surface of support 26, as taught in the Clerc ('820) patent. Anode plate 10 also comprises cathodoluminescent phosphor coatings $\mathbf{24}_R$, $\mathbf{24}_G$ and $\mathbf{24}_B$, deposited, respectively, over conductive regions $\mathbf{28}_R$, $\mathbf{28}_G$ and $\mathbf{28}_B$, so as to be directly facing and immediately adjacent gate electrode 22.

One or more microtip emitters 14 of the above-described structure are energized by applying a negative potential to conductors 13, functioning as the cathode electrode, relative to the gate electrode 22, via voltage supply 30, thereby inducing an electric field which draws electrons from the apexes of microtips 14. The freed electrons are accelerated toward a selected conductive region $\mathbf{28}_R$, $\mathbf{28}_G$ or $\mathbf{28}_B$, on anode plate 10, which region is selectively positively biased by the application of a substantially larger positive voltage from voltage supply 32 coupled to the three conductive regions $\mathbf{28}_R$, $\mathbf{28}_G$ and $\mathbf{28}_B$, functioning as anode electrodes. Energy from the electrons attracted to the anode conductor $\mathbf{28}_R$, $\mathbf{28}_G$ or $\mathbf{28}_B$, is transferred to the corresponding phosphor coating $\mathbf{24}_R$, $\mathbf{24}_G$ and $\mathbf{24}_B$, resulting in luminescence. The electron charge is transferred from phosphor coating $\mathbf{24}_R$, $\mathbf{24}_G$ or $\mathbf{24}_B$, to conductive region $\mathbf{28}_R$, $\mathbf{28}_G$ or $\mathbf{28}_B$, completing the electrical circuit to voltage supply 32.

The process for generating full-color images on the field emission flat panel display device of FIG. 1 consists of successively raising each set of interconnected anode conductors $\mathbf{28}_R$, $\mathbf{28}_G$ and $\mathbf{28}_B$ periodically to a potential which is sufficient to attract the electrons emitted by the microtips 14 on cathode plate 12 corresponding to the pixels which are to be illuminated in the color displayed by the corresponding energized phosphor coating $24_R$, $24_G$ or $24_B$. The anode stripes which are not being selected are set to a potential such that the electrons emitted by microtips 14 are repelled or have an energy level below the threshold cathodoluminescence energy level of the phosphor coatings $24_R$, $24_G$ and $24_B$ covering the unselected anode conductors $28_R$, $28_G$ and $28_B$. The attracting voltage is applied to each anode conductor $28_R$, $28_G$ and $28_B$ sequentially for the duration of its color field, wherein the sum of the three sequential color fields (one field of each color) is equal to one display frame. Because of the variations in the efficiencies of the phosphors which are typically used for the red, green and blue luminescences, the durations of the color fields and the amplitudes of the voltages on the anode electrodes are selected to provide a substantially pure white display when all three colors are fully illuminated in a sequence of sufficient frequency that the integrating effect of the eye merges all three color fields into a single image.

Figure 2:
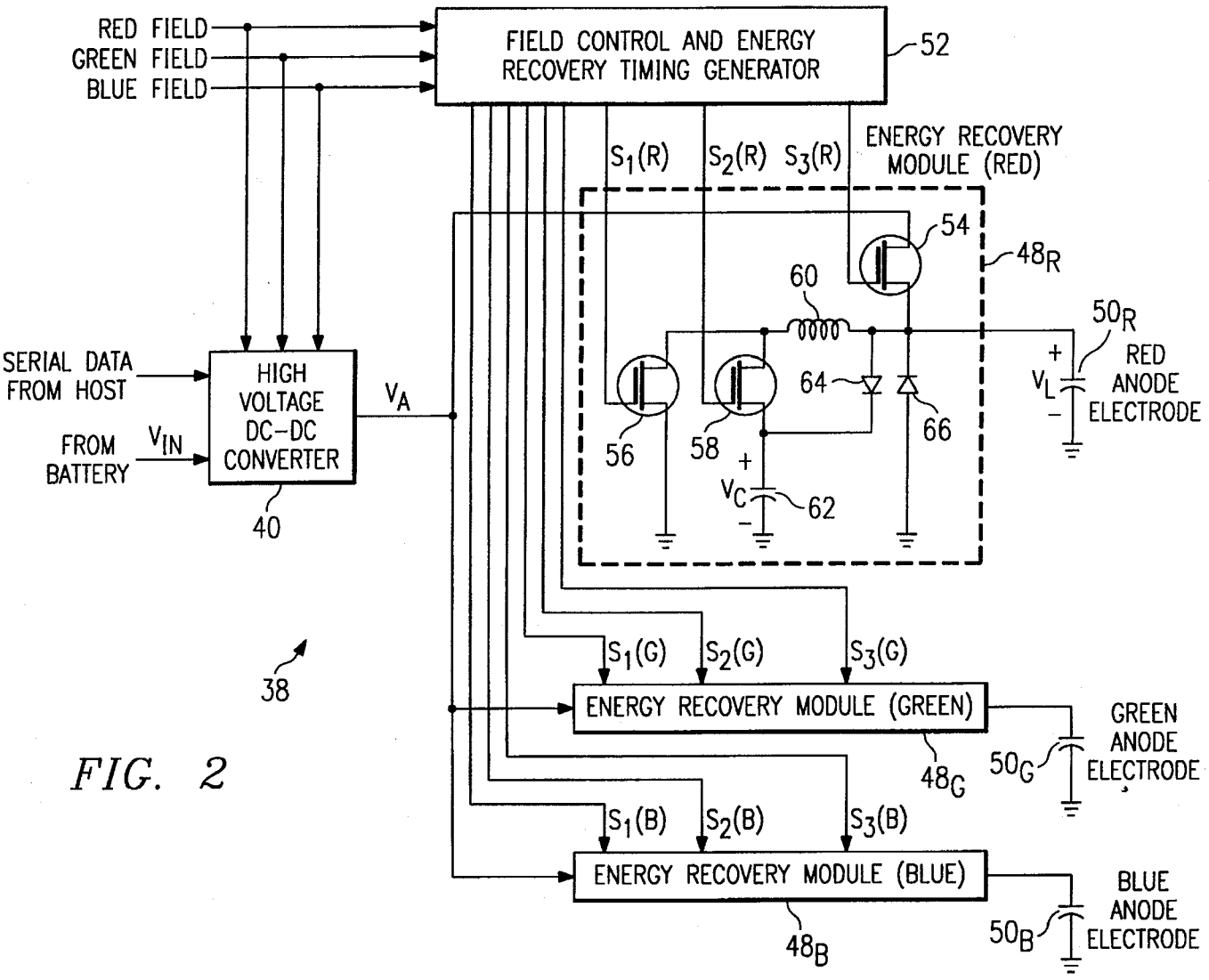
FIG. 2 illustrates an anode voltage source in accordance with the present invention, the voltage source providing energy recovery.

In accordance with the present invention, FIG. 2 illustrates an anode voltage source 38 which may be used as voltage supply 32 of FIG. 1. Anode voltage source 38 includes a high voltage dc—dc converter 40, which receives at its input terminal a dc voltage $V_{IN}$, which may typically be provided by a battery, illustratively in the range of 5 to 14 volts, and converts it to a substantially higher dc voltage, illustratively in the range of 500–800 volts. The actual magnitude of the output signal $V_A$ from converter 40 varies from one color field to the next, and is controlled by the SERIAL DATA input signal in conjunction with the RED FIELD, GREEN FIELD and BLUE FIELD signals.

Output voltage $V_A$ from high voltage dc—dc converter 40 is coupled to each of three energy recovery modules $48_R$, $48_G$ and $48_B$, referred to collectively as energy recovery modules 48. Detail is shown only for exemplary energy recovery module $48_R$, corresponding to the red field, energy recovery modules $48_G$ and $48_B$ being substantially identical thereto. Energy recovery modules $48_R$, $48_G$ and $48_B$ are also responsive to timing signals $S_1(R)$, $S_2(R)$ and $S_3(R)$; $S_1(G)$, $S_2(G)$ and $S_3(G)$; and $S_1(B)$, $S_2(B)$ and $S_3(B)$, respectively, received from field control and energy recovery timing generator 52. As will be noted below in the discussion of FIG. 3, the three timing signals associated with the red field, $S_1(R)$, $S_2(R)$ and $S_3(R)$, bear the same relationship to the RED FIELD input signal, as the corresponding three green timing signals $S_1(G)$, $S_2(G)$ and $S_3(G)$ bear to the GREEN FIELD input signal, which is also the same as the corresponding three blue timing signals $S_1(B)$, $S_2(B)$ and $S_3(B)$ bear to the BLUE FIELD input signal.

The output terminals of energy recovery modules $48_R$, $48_G$ and $48_B$ are coupled, respectively, to anode electrodes $50_R$, $50_G$ and $50_B$, which, because of the substantially capacitive nature of the load they represent (at least when their corresponding RED FIELD, GREEN FIELD or BLUE FIELD signals are disabled), are depicted as capacitors $50_R$, $50_G$ and $50_B$. Energy recovery module $48_R$ includes three switching devices 54, 56 and 58 which are illustrated as field effect transistors (FET's). FET 54, responsive at its control terminal to timing signal $S_3(R)$ from timing generator 52, provides a conduction path from $V_A$ to anode electrode $50_R$ and, through diode 64, to storage capacitor 62. FET 56, responsive at its control terminal to timing signal $S_1(R)$ from timing generator 52, provides a conduction path from inductor 60 to ground. FET 58, responsive at its control terminal to timing signal $S_2(R)$ from timing generator 52, provides a conduction path from inductor 60 to storage capacitor 62. Diode 66, coupled between the junction of the conduction path of FET 54 with anode electrode $50_R$ and ground, is poled so as to prevent anode electrode $50_R$ from becoming negatively charged.

While it is true that anode electrodes $50_R$, $50_G$ and $50_B$, present substantially capacitive loads when their corresponding RED FIELD, GREEN FIELD or BLUE FIELD signals are disabled, it will be recognized they may be represented as a capacitance in parallel with a resistance path for conducting the anode current passing through FET 54, while their corresponding RED FIELD, GREEN FIELD or BLUE FIELD signals are enabled.

Figure 3:
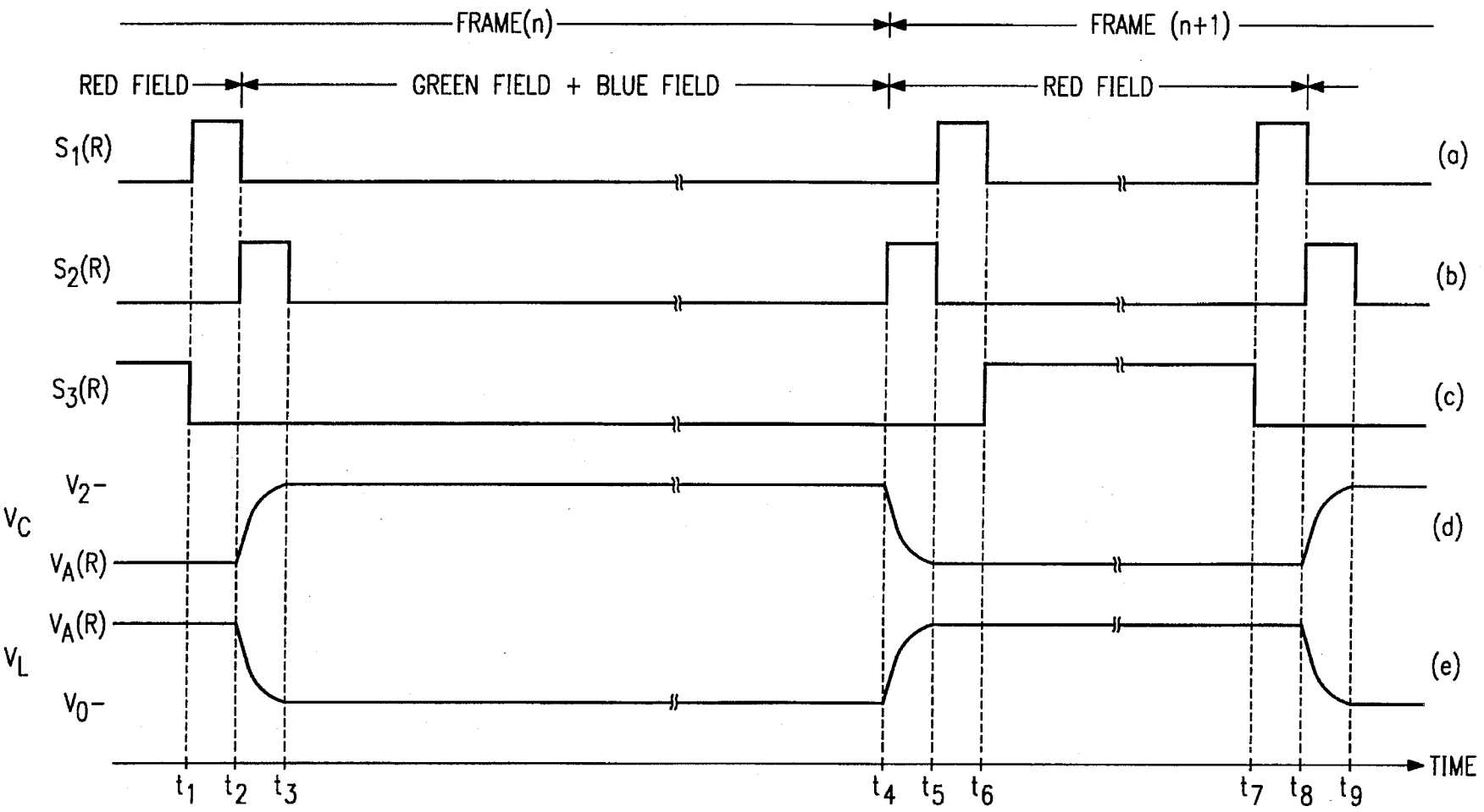
FIG. 3 is a set of timing diagrams useful in understanding the operation of the anode voltage source of FIG. 2.

Referring now to FIG. 3, there is shown a set of timing diagrams useful in understanding energy recovery modules 48 of FIG. 2. The waveforms of FIG. 3 relate directly to the red energy recovery module $48_R$; however, based on these waveforms, it will be easily understood how to apply the concepts of its operation, and the timing relationships, to the green and blue energy recovery modules $48_G$ and $48_B$. Furthermore, from the information provided herein relating to the timing pulse requirements of energy recovery modules 48, it is contended that one of skill in the art will be able m devise an energy recovery timing generator 52 which provides such timing pulse functions.

Under the initial conditions shown by the waveforms of FIG. 3, prior to $t_1$, signals $s_1(R)$ and $s_2(R)$ are both low, i.e., FET's 56 and 58 are both nonconducting, and signal $s_3(R)$ is high, i.e., FET 54 is conducting. In this mode, the voltage on the red anode electrode $50_R$, $V_L$, as shown in waveform (e) is at the red anode voltage, $V_A(R)$, and the voltage across storage capacitor 62, $V_c$, as shown in waveform (d) is also at the red anode voltage, $V_A(R)$.

The period from $t_1$ through $t_3$ may be thought of as the de-activation period. At time $t_1$, signal $s_1(R)$ goes high, i.e., FET 56 conducts, and signal $s_3(R)$ goes low, i.e. , FET 54 becomes nonconducting. In this mode, energy transfers from red anode electrode $50_R$ to inductor 60, while the voltage across storage capacitor 62 remains at $V_c$.

At time $t_2$, which coincides with the end of RED FIELD and the beginning of GREEN FIELD in this example, signal $s_1(R)$ goes low, i.e., FET 56 no longer conducts, and signal $s_2(R)$ goes high, i.e., FET 58 begins to conduct. In this mode, energy transfers from inductor 60 to storage capacitor 62. The voltage across storage capacitor 62 rises above the red anode voltage, $V_A(R)$, to $V_2$, as shown in waveform (d), as the energy from red anode electrode $50_R$ is transferred from inductor 60 to storage capacitor 62. If all of the energy in anode electrode $50_R$ were to be transferred to capacitor 62, twice the energy of anode electrode $50_R$ would have to be stored in capacitor 62, resulting in an increase in anode voltage $V_A(R)$ of approximately 41 percent ($2.0^{1/2}$=1.41). In the present example, where eighty percent of the energy in red anode electrode $50_R$ is recovered, ninety percent must be transferred to capacitor 62 (and ninety percent back to anode electrode $50_R$), resulting in an increase in anode voltage $V_A(R)$ of approximately 38 percent ($1.9^{1/2}$=1.38).

Waveform (e) shows that the voltage across red anode electrode $50_R$ drops to a reference voltage $V_O$, which is substantially at ground potential in this example. Diode 66 prevents red anode electrode $50_R$ from becoming negatively charged.

At time $t_3$, when the current flowing through inductor 60 drops to zero, signal $s_2(R)$ goes low, i.e., FET 58 stops conducting, and the voltage level across storage capacitor 62 is maintained. All of the energy from red anode electrode $50_R$ (minus the circuit losses) has been recovered into storage capacitor 62.

The period from $t_4$ through $t_6$ may be thought of as the re-activation period. At time $t_4$, which coincides with the end of BLUE FIELD and the beginning of RED FIELD in this example, signal $s_2(R)$ goes high, i.e., FET 58 becomes conducting. In this mode, energy transfers from storage capacitor 62 to inductor 60 and to red anode electrode $\mathbf{50}_R$, until the voltage across storage capacitance 62 is approximately equal to the red anode voltage, $V_A(R)$, as shown in waveforms (d) and (e).

At time $t_5$, signal $s_1(R)$ goes high, i.e., FET 56 begins to conduct, and signal $s_2(R)$ goes low, i.e., FET 58 ceases to conduct. In this mode, the remaining energy in inductor 60 is transferred to red anode electrode $\mathbf{50}_R$. All of the recovered energy (minus the circuit losses) has now been returned to red anode electrode $\mathbf{50}_R$.

At time $t_6$, when the current flowing through inductor 60 drops to zero, signal $s_1(R)$ goes low, i.e., FET 56 stops conducting, and signal $s_3(R)$ goes high, i.e., FET 54 begins to conduct. In this mode, the circuit has been restored to the state of the initial conditions, and high voltage dc—dc converter 40 provides the current which flows through the resistive component of red anode electrode $\mathbf{50}_R$.

It will be seen that the waveforms of FIG. 3 continue in repetitive manner, and that the conditions at time $t_7$ repeat those of time $t_1$, the conditions at time $t_8$ repeat those of time $t_2$, the conditions at time $t_9$ repeat those of time $t_3$, etc.

For an illustrative 10.5-inch VGA (640 columns by 480 rows) field emission display, each anode electrode $\mathbf{50}_R$, $\mathbf{50}_G$ and $\mathbf{50}_B$ has a typical capacitance value of approximately 10 nanofarads (nF). Thus, in order to store the energy from the capacitance of an anode electrode, storage capacitor 62 should be of the same value, or 10 nF. Storage capacitor 62 may be smaller than load capacitance $\mathbf{50}_R$, but the voltage to which storage capacitor 62 charges must be correspondingly higher in order to store the same amount of energy. Taking circuit losses into account, it is estimated that eighty percent of the energy is transferred from each anode electrode $\mathbf{50}_R$, $\mathbf{50}_G$ and $\mathbf{50}_B$ to its storage capacitor 62. Inductor 60 must therefore be of sufficient size to store this energy. The operational features relating to the transfer of video data to the display include a blanking time equal to one line (row) time of the field of display, and the transfer of energy must occur during this time, which, for a color field-sequential VGA display operating at a 60 Hz frame rate, is 12 microseconds (μsec).

In view of these requirements and limitations, it is determined, using standard electrical relationships, that inductor 60 preferably has an inductance value of 1.6 mH. Using 800 volts as the maximum anode voltage $V_A$, the energy stored in each anode electrode is approximately 3.2 mJ, and the current through inductor 60 during the 12 μseconds while eighty percent of this energy is being transferred between anode electrode $\mathbf{50}_R$, $\mathbf{50}_G$ or $\mathbf{50}_B$ and its storage capacitor 62 is approximately 1.8 amps.

The inductance value of 1.6 mH, determined from calculations using a time constant of 4 μsec and a load capacitance of 10 nF, should be considered as a theoretical maximum. The actual value may be somewhat smaller, since the energy transfer requires three time constants and since circuit losses increase the time constant, and the actual voltage transition time must occur in less than a single line time of 12 μsec to compensate for delays and margin.

By way of reminder, it will be recalled that the durations of the RED FIELD, GREEN FIELD and BLUE FIELD signals are individually selectable to provide, in conjunction with the amplitude of $V_A$ during each of the color field signals, a substantially pure white display when all three colors are fully illuminated.

Figure 4:
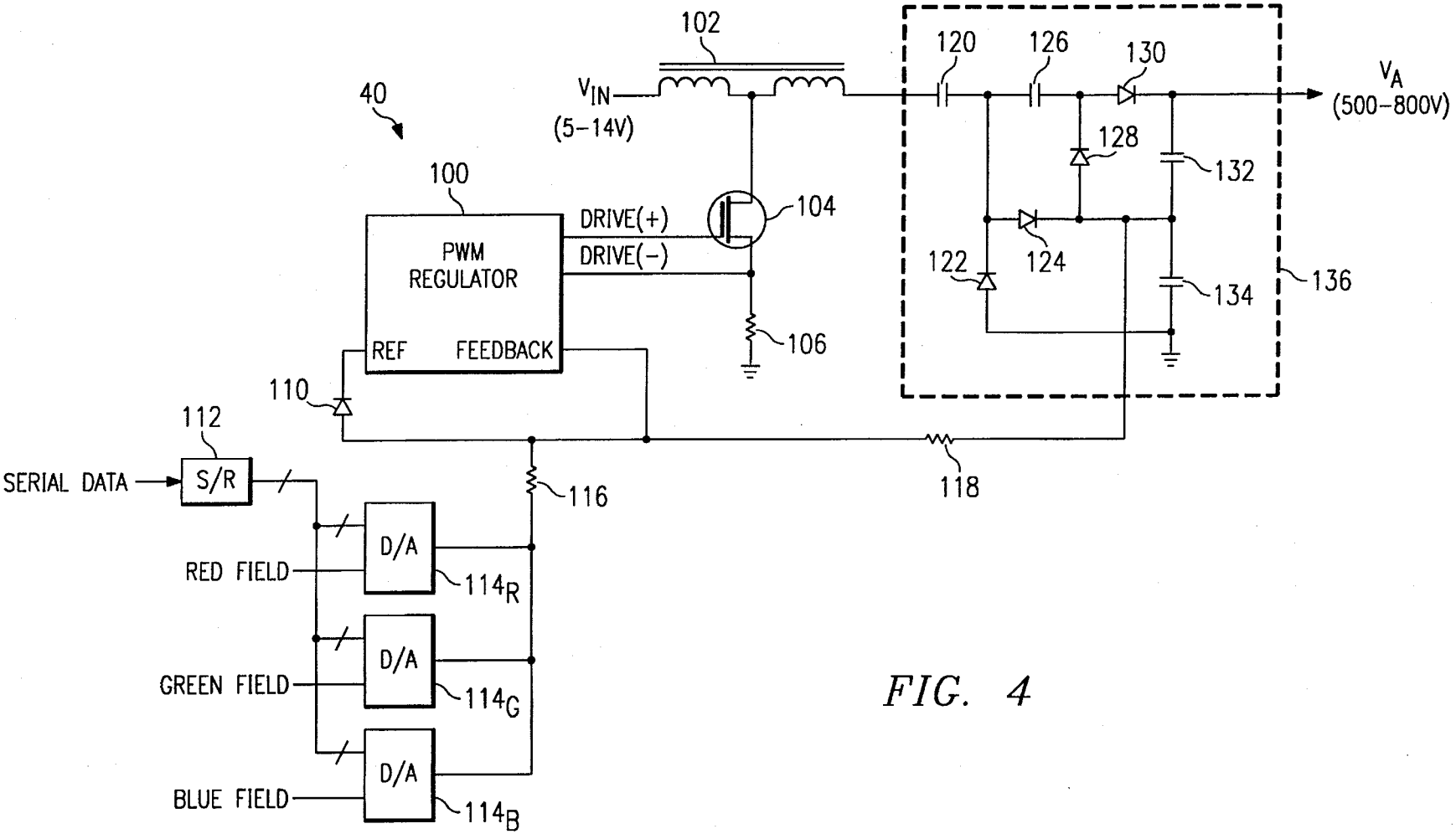
FIG. 4 is a circuit diagram of high voltage dc—dc converter which may be used in the anode voltage source of FIG. 2.

Referring now to FIG. 4, there is shown a circuit diagram of a converter which may be of the type shown in FIG. 2 as high voltage dc—dc converter 40. The anode voltage is generated and regulated from a pulse-width modulation (PWM) regulator 100 by controlling the on-time/off-time of transistor 104 and thus controlling the pulse width of the chopped dc voltage through transformer 102. PWM regulator 100 may, by way of example, be of a type sold as Model No. MAX741U by Maxim Integrated Products, of Sunnyvale, Calif. A voltage multiplier circuit 136, consisting of diodes 122, 124, 128 and 130, and capacitors 120, 126, 132 and 134, steps up the output voltage from transformer 102 so as to provide the maximum voltage needed. The actual output voltage from converter 40, referred to as anode voltage $V_A$, is controlled by the feedback voltage through the adjustable divider formed by resistors 116 and 118 and digital-to-analog (D/A) converters $\mathbf{114}_R$, $\mathbf{114}_G$ and $\mathbf{114}_B$.

A SERIAL DATA signal, illustratively provided from a host computer, is coupled through shift register 112, which loads individual digital data words corresponding to the anode voltage required for the red, green and blue color fields into D/A converters $\mathbf{114}_R$, $\mathbf{114}_G$and $\mathbf{114}_B$, respectively. These data words are loaded under the control of enabling signals RED FIELD, GREEN FIELD and BLUE FIELD, corresponding to the durations of the color fields. Each D/A converter $\mathbf{44}_R$, $\mathbf{44}_G$ and $\mathbf{44}_B$ then provides a tri-stated output control voltage which helps establish the level of $V_A$ which is commensurable with the required luminescence of its associated color.

Regulator 100 is operated in the classic boost configuration whereby the dc voltage $V_{IN}$ is increased significantly by field effect transistor 104 and transformer 102. To further increase anode voltage $V_A$ to the 500–800 volt range, the voltage multiplier circuit 136 is employed. Rectification and filtering is accomplished by diode 130 and capacitors 132 and 134. The individual voltages which are to be applied to the red green and blue anode electrodes $\mathbf{50}_R$, $\mathbf{50}_G$ and $\mathbf{50}_B$ are determined by the output signal levels of D/A converters $\mathbf{114}_R$, $\mathbf{114}_G$ and $\mathbf{114}_B$, which are switched into the feedback loop alternately by the RED FIELD, GREEN FIELD and BLUE FIELD mode control inputs. The closed loop gain of the circuit is thus modified by the output of each D/A converter $\mathbf{114}_R$, $\mathbf{114}_G$ or $\mathbf{114}_B$ in such a manner to give a range of voltages of 500–800 volts. Additionally, reference voltage $V_{REF}$ from regulator 100 is used to establish a stable reference voltage to operate functions such as current limit, soft-start, upper boundaries of the regulator output voltage, and under-voltage lockout. Diode 110 prevents the feedback voltage from exceeding the voltage limit set by PWM regulator 100.

Figure 5:
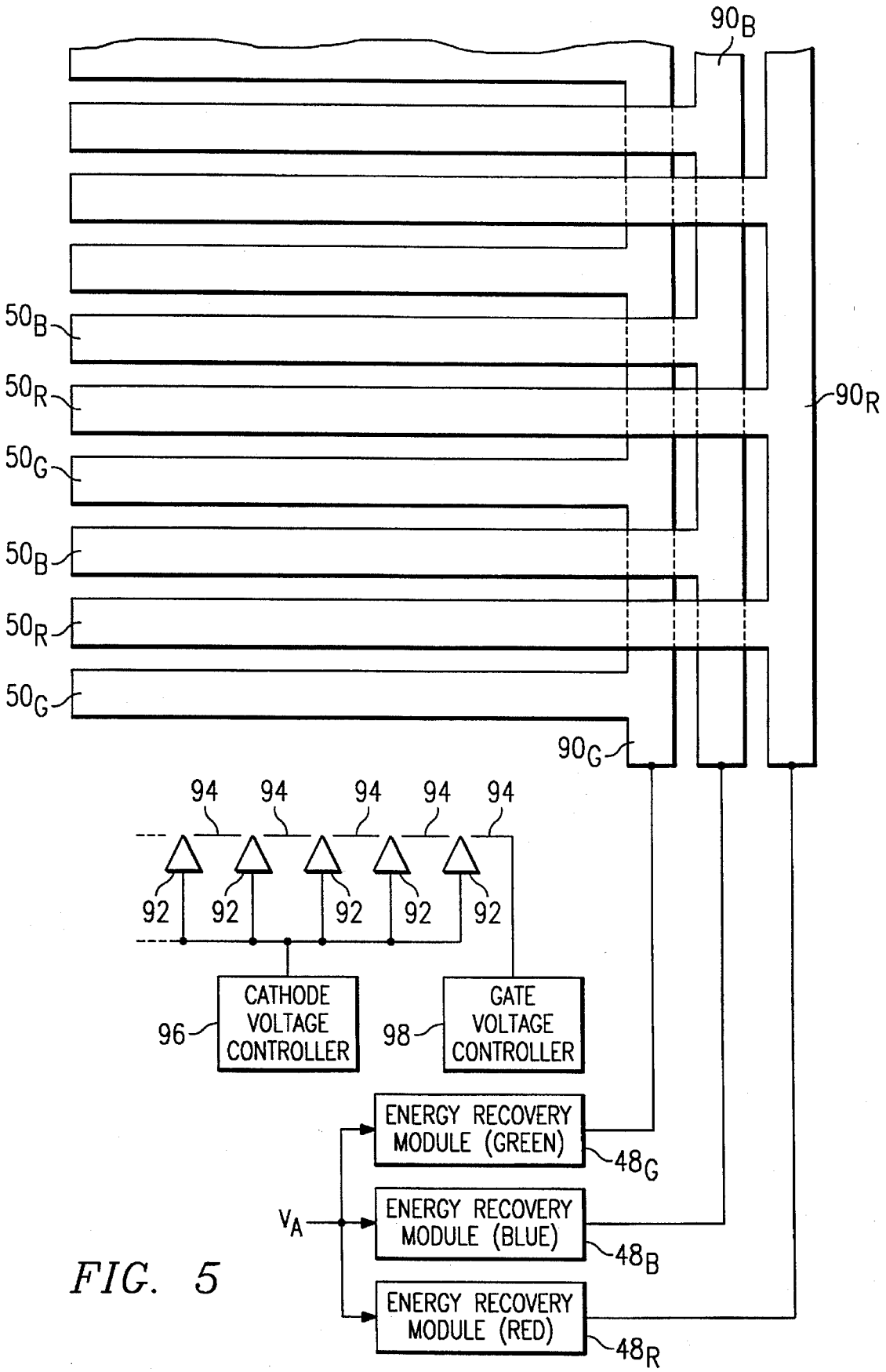
FIG. 5 illustrates a trichromatic field emission flat panel display device including the anode voltage source of FIG. 2.

Referring now to FIG. 5, there is shown, in block diagram form, elements of a trichromatic field emission flat panel display device including the energy recovery modules $\mathbf{48}_R$, $\mathbf{48}_G$ and $\mathbf{48}_B$ of anode voltage source 38 of FIG. 2. In this embodiment, anode electrodes $\mathbf{50}_R$, $\mathbf{50}_G$ and $\mathbf{50}_B$ are arranged as parallel stripes of alternating colors, the stripes of each color joined at one end to bus structures $\mathbf{90}_R$, $\mathbf{90}_G$ and $\mathbf{90}_B$, each of which is individually coupled to an energy recovery module $\mathbf{48}_R$, $\mathbf{48}_G$ and $\mathbf{48}_B$, respectively. Energy recovery modules $\mathbf{48}_R$, $\mathbf{48}_G$ and $\mathbf{48}_B$, comprise part of anode voltage source 38 shown in FIG. 2 and described in relation thereto, and are responsive to the voltages on the $V_A$ output signal from high voltage dc—dc converter 40 (of FIGS. 2 and 4).

The display device of FIG. 5 also includes a multiplicity of micropoint emitters 92, responsive to voltages provided by cathode voltage controller 96, and gate electrodes 94 adjacent emitters 92, the gate electrodes 94 being responsive to voltages provided by gate voltage controller 98. In a physical embodiment including emitters 92, gate electrodes 94 and anode electrodes 50, as will be recalled from an earlier description in relation to FIG. 1, emitters 92 and gates 94 are formed on a first plate which is positioned parallel to and in close proximity with a second plate including anodes 50, the two plates oriented such that emitters 92 and gates 94 are directly facing anodes 50. The second plate also comprises red-, green- and blue-luminescing cathodoluminescent phosphor coatings deposited, respectively, over anode electrodes $\mathbf{50}_R$, $\mathbf{50}_G$ and $\mathbf{50}_B$, directly facing gate electrodes 94. Energy from the electrons attracted to anode electrodes $\mathbf{50}_R$, $\mathbf{50}_G$ and $\mathbf{50}_B$, is transferred to the corresponding phosphor coating resulting in luminescence.

An illustrative method by which the excitations of emitters 92, gate electrodes 94 and anode electrodes $\mathbf{50}_R$, $\mathbf{50}_G$ and $\mathbf{50}_B$, by cathode voltage controller 96, gate voltage controller 98 and anode voltage source 38 (via energy recovery modules $\mathbf{48}_R$, $\mathbf{48}_G$ and $\mathbf{48}_B$), respectively, produce color images resulting from three successive scans of the display screen corresponding to three fields of red, green and blue, is set forth in the Clerc patent.

A switching power supply for use in a switched anode, field emission flat panel display, as disclosed herein, including energy recovery modules for recovering energy from each anode electrode of the display as the voltage on the anode is switched from a high energy state to a low energy state, and for restoring this energy to the anode as the voltage is returned from the low level back to the high level, overcomes limitations and disadvantages of prior art devices. The transfer and storage of energy, and its reuse when the anode electrode is switched back to its high voltage state, allows the recovery of as much as eighty percent of the energy applied to the anode electrodes. Hence, for the application to fiat panel display devices envisioned herein, the approach in accordance with the present invention provides significant advantages.

While the principles of the present invention have been demonstrated with particular regard to the structures and methods disclosed herein, it will be recognized that various departures may be undertaken in the practice of the invention. The scope of the invention is not intended to be limited to the particular structures and methods disclosed herein, but should instead be gauged by the breadth of the claims which follow.

What is claimed is:

1. A switching power supply for providing a dc potential intermittently across a substantially capacitative load device, said power supply comprising:

means responsive to an energy source for providing said dc potential, said providing means including a control input terminal responsive to a control signal thereat for controlling the amplitude of said dc potential;

voltage storage means;

first switching means for selectively coupling said dc potential to said load device and to said voltage storage means;

energy storage means coupled at a first terminal thereof to said load device;

second switching means for selectively coupling a second terminal of said energy storage means to said voltage storage means; and third switching means for selectively coupling said second terminal of said energy storage means to a reference potential.

2. The apparatus in accordance with claim 1 wherein at least one of said first, second and third switching means comprises a transistor.

3. The apparatus in accordance with claim 1 wherein said voltage storage means comprises a capacitor.

4. The apparatus in accordance with claim 1 wherein said energy storage means comprises an inductor.

5. The apparatus in accordance with claim 1 wherein said means for providing said dc potential comprises a dc—dc converter responsive at its input to a battery voltage.

6. The apparatus in accordance with claim 1 further including an analog-to-digital converter coupled at its output terminal to said control input terminal.

7. The apparatus in accordance with claim 1 wherein said means for providing said dc potential further includes a pulse-width modulation regulator.

8. A switching power supply for providing dc potentials sequentially across a plurality of substantially capacitative load devices, said dc potentials being individually determined for each of said load devices, said power supply comprising:

means responsive to an energy source and responsive to a plurality of control voltages for providing at an output terminal thereof sequences of said dc potentials;

energy recovery modules equal in number to the number of load devices, each of said energy recovery modules coupled to an individual one of said load devices and to said providing means output terminal, each of said energy recovery modules comprising:

voltage storage means;

first switching means for selectively coupling said dc potential from said output terminal of said providing means to said one load device and to said voltage storage means;

energy storage means coupled at a first terminal thereof to said one load device;

second switching means for selectively coupling a second terminal of said energy storage means to said voltage storage means; and third switching means for selectively coupling said second terminal of said energy storage means to a reference potential; and means coupled to said plurality of energy recovery modules for generating timing control signals to said first, second and third switching means thereof.

9. The switching power supply in accordance with claim 8 wherein said generating means generates timing control signals to said energy recovery modules timed to provide said dc potentials alternately across said plurality of load devices.

10. Display apparatus for use in a field emission device, said apparatus comprising:

a substantially transparent substrate;

spaced-apart, electrically conductive regions on said substrate;

luminescent material overlaying said conductive regions; and means for applying dc potentials sequentially to said conductive regions, said applying means comprising:

means responsive to an energy source and responsive to a plurality of control voltages for providing at an output terminal thereof sequences of said dc potentials;

energy recovery modules equal in number to the number of said conductive regions, each of said energy recovery modules coupled to an individual one of said conductive regions and to said providing means output terminal, each of said energy recovery modules comprising:

voltage storage means;

first switching means for selectively coupling said dc potential from said output terminal of said providing means to said one conductive region and to said voltage storage means;

energy storage means coupled at a first terminal thereof to said one conductive region;

second switching means for selectively coupling a second terminal of said energy storage means to said voltage storage means; and third switching means for selectively coupling said second terminal of said energy storage means to a reference potential; and means coupled to said plurality of energy recovery modules for generating timing control signals to said first, second and third switching means thereof.

11. An electron emission display apparatus comprising:

an emitter structure including means for emitting electrons;

a display panel having a substantially planar face opposing said emitter structure, said display panel including a substantially transparent substrate, spaced apart, electrically conductive regions on said substrate, and luminescent material overlaying said conductive regions; and means for applying dc potentials sequentially to said conductive regions so as to accelerate electrons emitted by said emitting means toward said conductive regions, said applying means comprising:

means responsive to an energy source and responsive to a plurality of control voltages for providing at an output terminal thereof sequences of said dc potentials;

energy recovery modules equal in number to the number of said conductive regions, each of said energy recovery modules coupled to an individual one of said conductive regions and to said providing means output terminal, each of said energy recovery modules comprising:

voltage storage means;

first switching means for selectively coupling said dc potential from said output terminal of said providing means to said one conductive region and to said voltage storage means;

energy storage means coupled at a first terminal thereof to said one conductive region;

second switching means for selectively coupling a second terminal of said energy storage means to said voltage storage means; and third switching means for selectively coupling said second terminal of said energy storage means to a reference potential; and means coupled to said plurality of energy recovery modules for generating timing control signals to said first, second and third switching means thereof.

* * * * *